US007674214B2

(12) United States Patent
Marethouse et al.

(10) Patent No.: US 7,674,214 B2
(45) Date of Patent: Mar. 9, 2010

(54) BARBELL HANDLES

(76) Inventors: David Marethouse, 6538 Olympia Buddy Rd., College Station, TX (US) 77845; Johnny Kloesel, 5057 Drake Dr., College Station, TX (US) 77845

( * ) Notice: Subject to any disclaimer, the term of this patent is extended or adjusted under 35 U.S.C. 154(b) by 0 days.

(21) Appl. No.: 11/906,254

(22) Filed: Oct. 1, 2007

(65) Prior Publication Data

US 2009/0088305 A1 Apr. 2, 2009

(51) Int. Cl.
*A63B 71/00* (2006.01)

(52) U.S. Cl. ..... 482/139; 482/126; 482/108

(58) Field of Classification Search ..... 482/139, 482/38, 92–108, 148, 14, 16, 109, 126
See application file for complete search history.

(56) References Cited

U.S. PATENT DOCUMENTS 4,463,977 A * 8/1984 Wyatt ..... 294/26
4,484,740 A 11/1984 Green et al. ..... 272/119
4,955,650 A * 9/1990 Davey ..... 294/26
5,182,814 A 2/1993 Christensen et al. ..... 2/161 A
6,247,739 B1 * 6/2001 Lyon ..... 294/159
6,939,274 B2 * 9/2005 Emick ..... 482/104
7,213,851 B2 * 5/2007 Mann ..... 294/26

* cited by examiner

*Primary Examiner*—Lori Baker
(74) *Attorney, Agent, or Firm*—Medlen & Carroll, LLP

(57) ABSTRACT

The invention relates to methods and an apparatus used to lift a barbell. In some embodiments, the invention relates to an apparatus having a centralized handle and opposing hooks extending away from and attached to opposing ends of said handle. In other embodiments, the invention relates to methods for attaching said hooks to a barbell to assist in the performance of weight-bearing exercise and lifting.

3 Claims, 6 Drawing Sheets

BARBELL HANDLES

FIELD OF INVENTION

The invention relates to methods and an apparatus used to lift a pole, preferably a barbell. In some embodiments, the invention relates to an apparatus having a centralized handle and opposing hooks extending away from and attached to opposing ends of said handle. In other embodiments, the invention relates to methods for using said hooks to grab a barbell to assist in the performance of weight-bearing exercise and lifting such as squats.

BACKGROUND

There exist myriad of muscle strenghtening exercises involving the manipulation of weight-bearing apparatus including barbells. Among the most popular and effective exercises for the strengthening of the legs and/or lower back are squat exercises, deadlifts and lunges. The weight-bearing barbells and barbell supporting rack systems are typically designed without significant variation in their dimensions. Thus, the equipment utilized in these exercises presents unique challenges to individuals whose physical dimensions encumber their performance possibly resulting in injury. Thus, there is a need for improved methods and apparatus to accommodate individuals that would otherwise be hindered or potentially injured in the performance of such exercises.

SUMMARY OF INVENTION

The invention relates to methods and an apparatus used to lift a pole, preferably a barbell. In some embodiments, the invention relates to an apparatus having a centralized handle and opposing hooks extending away from and attached to opposing ends of said handle. In other embodiments, the invention relates to methods for using said hooks to grip, grab, grasp or otherwise engage a barbell to assist in the performance of weight-bearing exercise and lifting such as squats.

In some embodiments, the invention relates to an apparatus, comprising: a handle comprising a first end and a second end; and a first hook comprising a first bent end and a first arm and a second hook comprising a second bent end and a second arm; wherein said first handle end is connected to said first hook arm and said second handle end is connected to said second hook arm; wherein said first hook bent end and said second hook bent end are configured to be pointed in opposite directions and spacially overlapping within a plane that is parallel to a longitudinal axis of said handle. In other embodiments, said first bent end and said second bent end are configured to hold a pole comprising a top and a bottom. In additional embodiments, said first and second hooks are configured to create a space between said first and second hooks such that a pole can be placed between said first and second hook arms without passing over said pole top and bottom. In still further embodiments, said first bent end and said second bent end are configured to both contact a pole that lies between said first and second bent ends of the hooks. In additional embodiments, said hook arms extend outwardly substantially perpendicular with regard to the longitudinal axis of said handle. In further embodiments, said handle and said hooks are comprised of a material selected from the group consisting of metal, metal alloy or polymer. In additional embodiments, said first and second hook arms are attached to the longitudinal axis of said first and second ends of said handle.

In some embodiments, the invention relates to an exercise system, comprising: a barbell comprising a pole; and an apparatus comprising: a handle comprising a first end and a second end; and a first hook comprising a first bent end and a first arm and a second hook comprising a second bent end and a second arm; wherein said first handle end is connected to said first hook arm and said second handle end is connected to said second hook arm; wherein said first hook bent end and said second hook bent end are configured to be pointed in opposite directions and spacially overlapping within a plane that is parallel to a longitudinal axis of said handle; wherein said first bent end and said second bent end are configured to hold said pole.

In some embodiments, the invention relates to a method for performing an exercise comprising: providing: a person comprising a hand, a barbell comprising a pole, and the apparatus of claim 1; grasping, grabbing or otherwise engaging the handle of said apparatus with said hand; grasping, grabbing or otherwise engaging said pole with said hooks of said apparatus; and performing an exercise by said person wherein said barbell is moved (e.g. up or down, alternatively out away from the body or in toward the body, or a combination of such movements). In further embodiments, said exercise is selected from the group consisting of squat exercises, dead lifts and lunges.

DETAILED DESCRIPTION OF INVENTION

The invention relates to methods and an apparatus used to lift a barbell. In some embodiments, the invention relates to an apparatus having a centralized handle and opposing hooks extending away from and attached to opposing ends of said handle. In other embodiments, the invention relates to methods for attaching said hooks to a barbell to assist in the performance of weight-bearing exercise and lifting.

It is not intended that the present invention be limited to activities such as exercise. Activities such as construction, landscaping, and manufacturing also require heavy lifting (e.g. of bars, beams, columns, and the like) and can readily be improved through the utilization of embodiments of the present invention.

In certain embodiments, the invention relates to apparatus for assisting in and enhancing the performance of barbell exercises. U.S. Pat. No. 5,182,814 provides for a weight-supporting glove that is fashioned to a flap supplemented with a Velcro strip. The flap is wrapped around the handle of a barbell for assistance in supporting the weight. U.S. Pat. No. 6,939,274 discloses an apparatus for lifting a dumbbell. U.S.

Pat. No. 4,484,740 describes a weight training apparatus for attachment to the forearm of an individual, extending from the below the elbow and capable of being affixed to a dumbbell or barbell. However, it is believed that there is nothing in the art that provides for methods and apparatus that hold heavy weights to accommodate the performance of barbell exercises related to the strengthening of leg and lower back muscles for individuals with physical dimensions that would otherwise be hindered or encumbered during the performance of said exercises.

Figure 1:
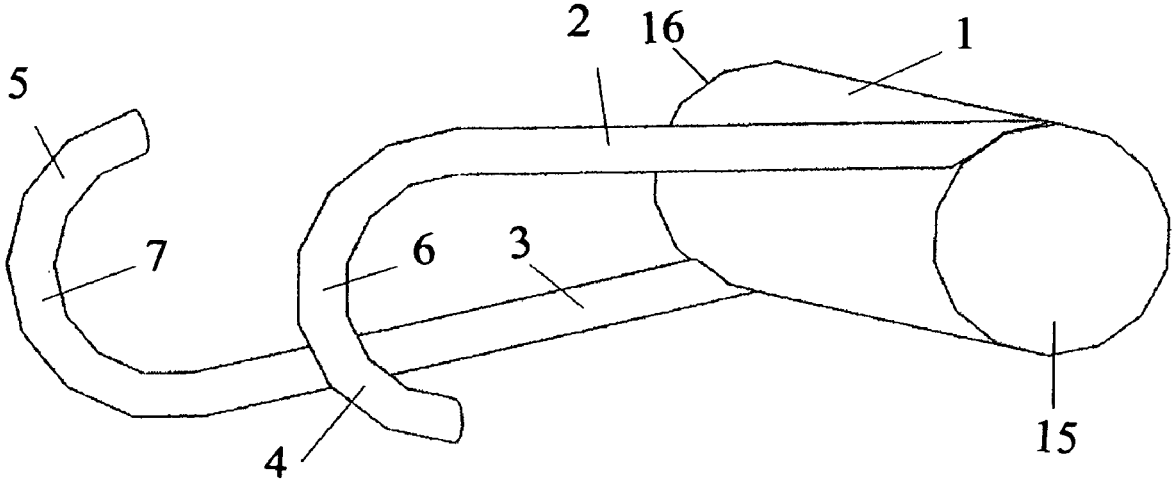
FIG. 1 illustrates one embodiment of the apparatus of the current invention.

FIG. 1 shows an apparatus having a handle (1) with a first end (15) and a second end (16) and a first hook (6) comprising a first bent end (4) and a first arm (2) and a second hook (7) comprising a second bent end (5) and a second arm (3). The first handle end (15) is connected to said first hook arm (2) and said second handle end (16) is connected to said second hook arm (3). The first hook bent end (4) and said second hook bent end (5) are configured to be pointed in opposite directions and spatially overlapping within a plane that is parallel to a longitudinal axis of said handle (1).

Figure 2:
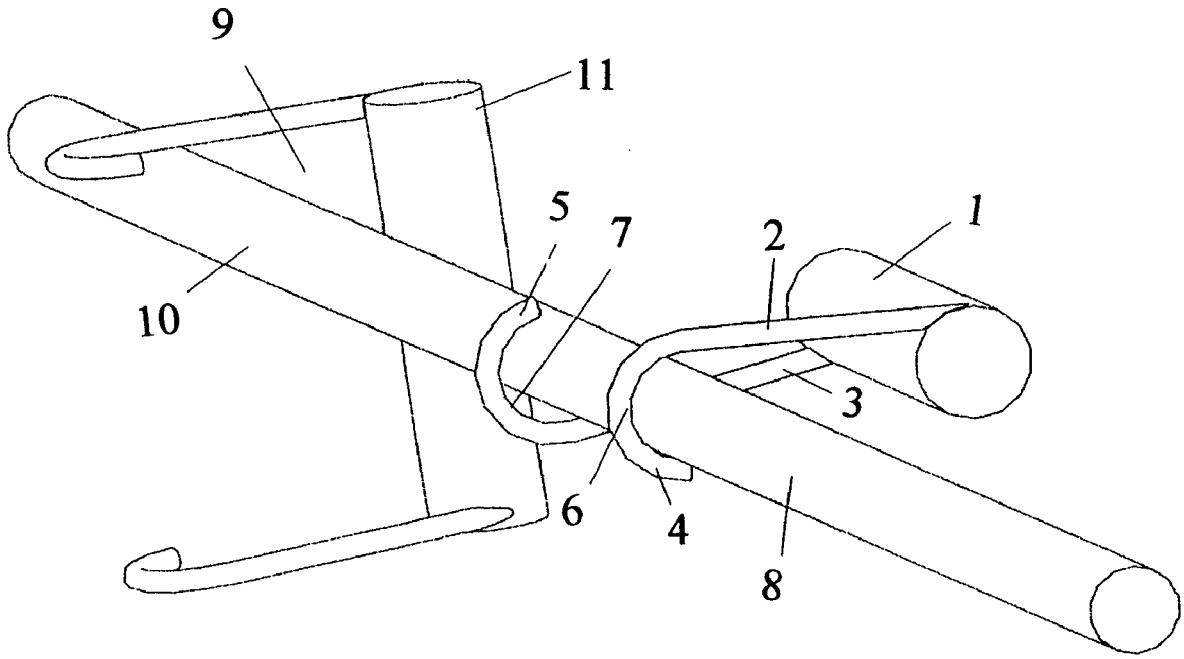
FIG. 2 illustrates moving the apparatus of one embodiment of the current invention over a pole.

FIG. 2 shows the apparatus of FIG. 1 being passed over a pole (10) by aligning a handle (11) in a perpendicular plane (9) with reference to said pole (10). When an individual twists a handle (1) such that a first hook (6) having a first bent end (4) and a first arm (2) and a second hook (7) comprising a second bent end (5) and a second arm (3)-are similarly twisted, said first bent end (4) and said second bent end (5) contact said pole (10).

Figure 3:
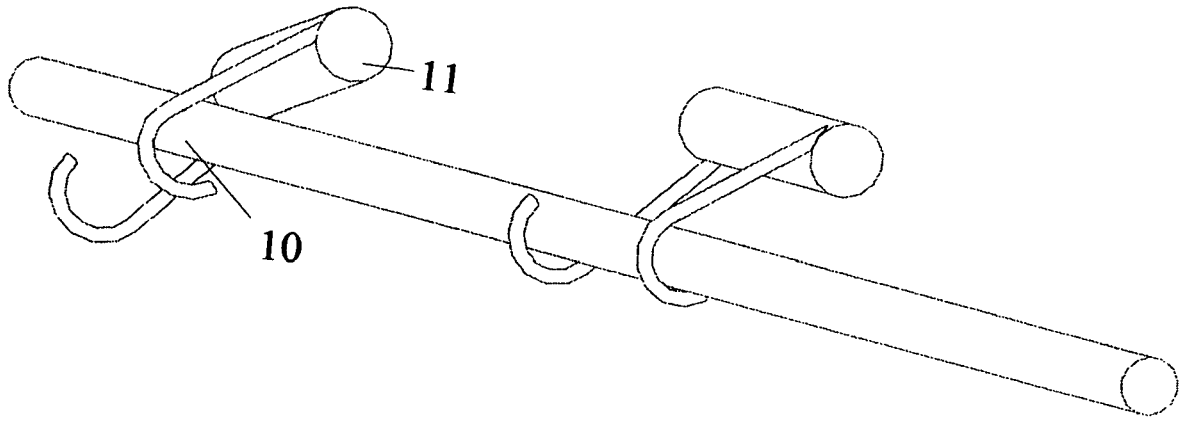
FIG. 3 illustrates grabbing or engaging a pole with one embodiment of the apparatus by rotating the handle of the apparatus.

FIG. 3 shows an alternative perspective of a handle (11) being twisted in reference to a pole (10).

Figure 4:
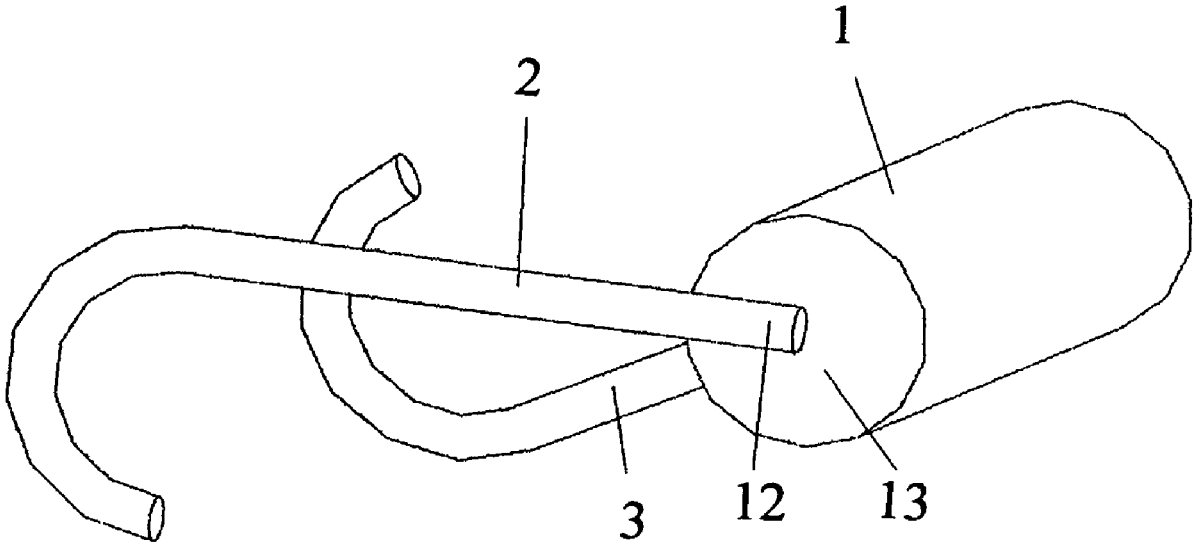
FIG. 4 illustrates that the arms of one embodiment of the apparatus can be connected to different portions of the ends of the handle.

FIG. 4 shows an alternative view of an apparatus having a handle (1) with an end (13) and a first hook arm (2) contacted at a point of attachment (12) to said handle (1). A second hook arm (3) is arranged on the opposing end of said handle (1) with respect to said first hook arm (2).

Figure 5:
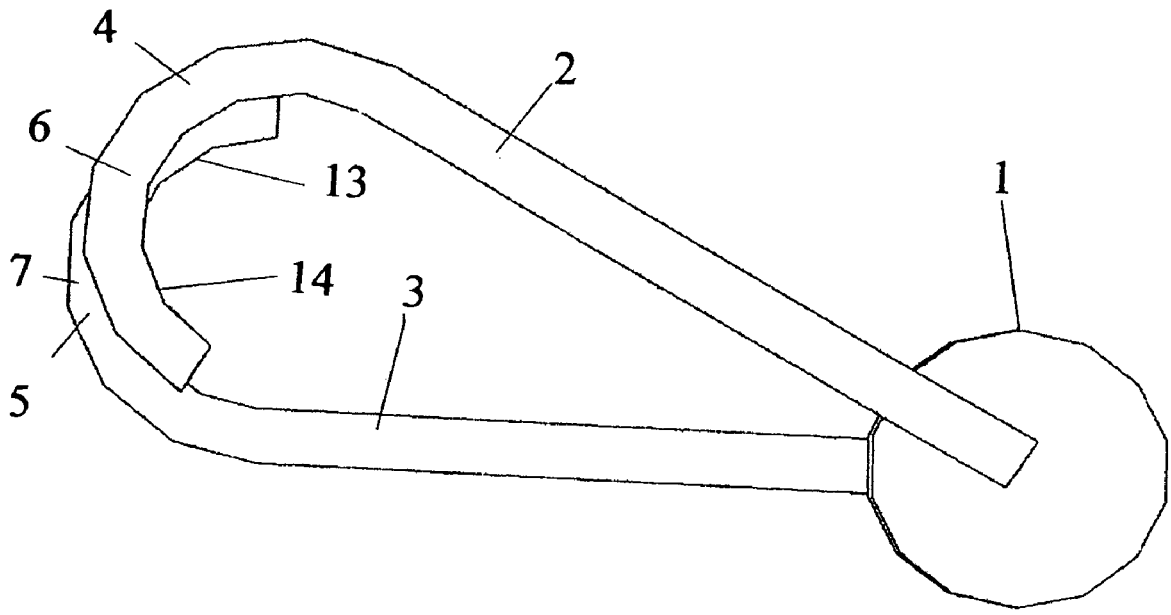
FIG. 5 illustrates the overlapping ends of the hooks of one embodiment.

FIG. 5 shows an alternative view of an apparatus having a handle (1) with a first hook (6) having a first bent end, (4) with a portion of said first bent end configured for holding a pole (14) and a first arm (2); and a second hook (7) having a second bent end, (5) with a portion of said second bent end configured for holding a pole (13) and a second arm (3). The first hook bent end (4) and said second hook bent end (5) are configured to be pointed in opposite directions and spatially overlapping within a plane that is parallel to a longitudinal axis of said handle (1).

Figure 6A:
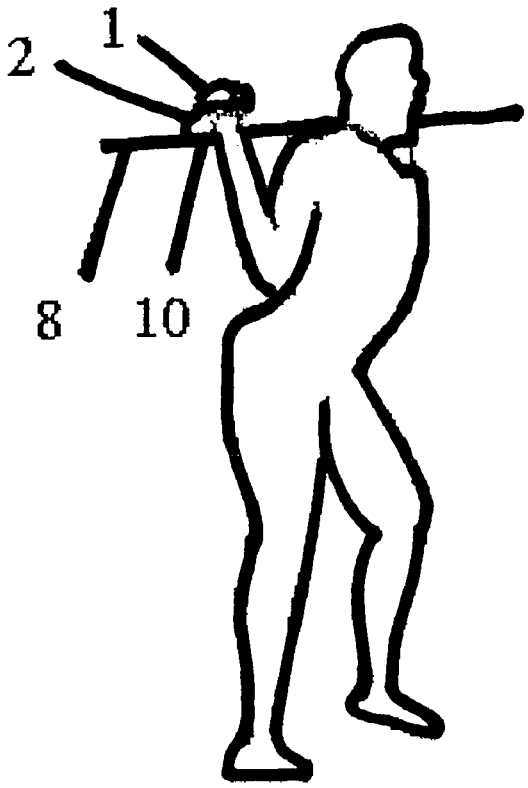
FIG. 6A illustrates a person grabbing or engaging the handle of the apparatus and grabbing or engaging a pole with the apparatus.

FIG. 6A shows an individual grasping, grabbing or otherwise engaging an apparatus comprising a handle (1) and a hook arm (2) that is contacting a pole (10) at a position on said pole (8).

Figure 6B:
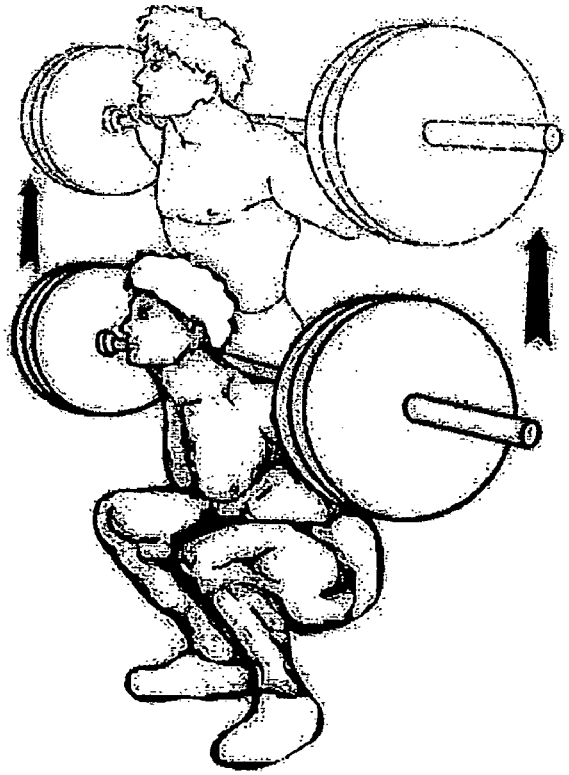
FIG. 6B illustrates a person squatting that is exercising.

FIG. 6B shows an individual performing a squat exercise.

As used herein, a "handle" refers to a part that is designed to be held or operated with a hand or foot. It is not intended that the handle be limited to any particular composition; for example, a handle may be comprised of a metal, metal alloy or polymer. Furthermore, it is intended that the handle may be a variety of shapes or sizes; for example, the handle may be fashioned into the shape of a tube or it may be ergonomically designed to mate with the palm of a hand. It is also not intended that the present invention be limited to how elements are attached to the handle (e.g. whether through bolts, through male-female engaging elements, or the like).

As used herein, a "hook" refers to an arm curved at the end. The hook may be used to grasp, grab or otherwise engage a pole (or beam, column, etc.), preferably a piece of exercise equipment that contains a pole and even more preferably a barbell. It is not intended that the hook be limited to any particular composition; for example, a hook may be comprised of a metal, metal alloy or polymer. Furthermore, it is not intended that the hook be limited to any particular length or circumference. Within certain preferred embodiments, a pair of hooks is configured to be pointed in opposite directions, i.e. the ends of the hooks do not point in a similar direction nor do they point towards each other. Within certain embodiments, hooks are spacially overlapping within a plane, i.e. from a perspective of a two-dimensional view of the hooks. An example of such a view is provided in FIG. 5. It is not intended to require that the bent part of the hooks be completely overlapping; they may be partially overlapping, as illustrated in FIG. 5.

As used herein, a "pole" refers to a piece of material whose dimensions are generally longer than they are wide. Preferably, the pole is rounded to facilitate grabbing the pole at some portion of the long axis of the pole As used herein, a "squat exercise" or "squat" refers to an exercise wherein a person bends their knees and lowers their buttocks. An example of a squat is provided in FIG. 6B.

As used herein, a "deadlift" refers to an exercise where a person lifts a barbell off the ground from a stabilized, bent-over bodily position.

As used herein, a "lunge" refers to an exercise steps either forward or backwards with one foot and lowers their buttocks.

EXAMPLES

Example 1

A person attempts to do a squat. To aid in performance of squat, applicant attempts to perform squat using an extendable joint that is harnessed atop each of the person's shoulders. The pole and corresponding weight is unstable. The person is not able to perform a squat without a risk of injury.

Example 2

A person attempts to perform a squat with a weight on a squat rack. Due to the person's large chest and torso areas, the person is uncomfortable upon moving the weight from the weight rack. To prevent injury, instead of grabbing the pole with their hand, the person uses the apparatus as described in FIG. 5. The person grasps the handle using the apparatus by stepping under the pole and twisting the apparatus such that the pole is gripped with the apparatus. The person is able to perform a squat exercise with more weight and with more comfort than is possible for such an individual in the absence of such an apparatus.

We claim:

1. An exercise system, comprising:

a) a barbell comprising a pole; and b) an apparatus comprising:

i) a handle comprising a first end and a second end;

ii) a first hook comprising a first bent end and a first arm; and iii) a second hook comprising a second bent end and a second arm;

wherein said first handle end is connected to said first hook arm and said second handle end is connected to said second hook arm;

wherein said first hook bent end and said second hook bent end point in opposite directions and spatially overlap within a plane parallel to a longitudinal axis of said handle;

wherein said first hook bent end and said second hook bent end engage said pole.

2. A method for performing an exercise comprising:

a) providing:

i) a barbell comprising a pole, and ii) an apparatus comprising:

1) a handle comprising a first end and a second end:

2) a first hook comprising a first bent end and a first arm: and 3) a second hook comprising a second bent end and a second arm;

wherein said first handle end is connected to said first hook arm and said second handle end is connected to said second hook arm;

wherein said first hook bent end and said second hook bent end point in opposite directions and spatially overlap within a plane parallel to a longitudinal axis of said handle;

b) engaging said pole with said hooks of said apparatus; and c) lifting said barbell with said apparatus.

3. The method of claim 2, wherein said lifting comprises an exercise selected from the group consisting of squat exercises, dead lifts and lunges.

* * * * *